US005759121A

United States Patent [19]

Rogers et al.

[11] Patent Number: 5,759,121

[45] Date of Patent: Jun. 2, 1998

[54] BASKETBALL RIM ASSEMBLY

[76] Inventors: Tim Rogers, 18 Pinebrook Hollow, Unionville, Onatrio, Canada, L3R 3Z8; Frank Ritchie, 40 Longwood Court, Courtice, Ontario, Canada, L1E 1R7

[21] Appl. No.: 685,964

[22] Filed: Jul. 22, 1996

[51] Int. Cl.[6] ..... A63B 63/08

[52] U.S. Cl. ..... 473/488; 473/485; 248/222.13

[58] Field of Search ..... 473/485, 488, 473/479, 481; 248/221.11, 222.13, 222.14; 81/15.9, 486, 436, 459; 294/19.1

[56] References Cited

U.S. PATENT DOCUMENTS

| | | | |
|---|---|---|---|
| 680,560 | 8/1901 | Barnes | 81/459 |
| 922,630 | 5/1909 | Reach | 473/488 |
| 4,613,135 | 9/1986 | Rush | 473/488 |
| 4,921,248 | 5/1990 | Rapp | 473/488 |
| 5,022,649 | 6/1991 | Traub et al. | 473/488 |
| 5,480,139 | 1/1996 | Owens, Jr. et al. | 473/485 X |

*Primary Examiner*—Raleigh W. Chiu
*Attorney, Agent, or Firm*—Eugene J. A. Gierczak

[57] ABSTRACT

A basketball rim assembly includes an anchoring plate having a mounting assembly, a back plate, a support member, a rim and a locking mechanism. The anchoring plate is removably attached to the back plate by the mounting assembly, and the locking mechanism, comprising of a cam assembly, locks the back plate to the anchoring plate allowing for the safe and easy removal and placement of the rim.

12 Claims, 3 Drawing Sheets

BASKETBALL RIM ASSEMBLY

FIELD OF INVENTION

This invention relates in general to basketball equipment and more particularly to a basketball rim assembly.

1. Background Art

Basketball has become a national past time that is played both at schools and at home. Conventional basketball courts are often found at schools and public playgrounds, and even in private driveways. One problem with these conventional play areas, is that the equipment is susceptible to vandalism or damage when the play areas are left unattended. Equipment specifically targeted is the hoop or rim assembly which can be bent, damaged or removed during these unsupervised times.

Prior art basketball rim assemblies have been devised to address the aforenoted problems. For example, U.S. Pat. No. 922,630 issued May 25, 1909, relates to basketball goals, and particularly a means for supporting the basket to the wall whereby the goal or basket is firmly held and may readily be attached and detached from the wall. U.S. Pat. No. 1,522,957 issued Dec. 14, 1923, relates to a basketball goal having a means whereby it may be detachably supported upon a supporting wall in such a manner as to be instantly removable for the purpose of safekeeping or for any other cause.

U.S. Pat. No. 4,613,135 issued on Sep. 23, 1986, relates to a quick change device for a basketball goal which comprises of a receptacle member securable to a backboard, and goal-mounting member for slidable mounting on the receptacle member. U.S. Pat. No. 5,156,395 issued on Oct. 20, 1992, relates to an adjustable height basketball goal, including a vertical column having angled corners and a beam extending up from the column. U.S. Pat. No. 4,921,248 issued on May 1, 1990, relates to a basketball rim assembly that includes a base member for mounting on a basketball backboard.

Thus a basketball rim assembly which can be removed safely, easily and quickly to preserve the equipment, yet be securely attached during play to a pole, back board or plate, is desirable.

2. Disclosure of Invention

An object of one aspect of the present invention is to provide an improved basketball rim assembly.

In accordance with one aspect of the present invention there is provided a basketball rim assembly for mounting on a surface comprising of an anchoring plate, a back plate, a support member, a rim and a locking mechanism. The anchoring plate can be mounted on a surface and removably attached to the back plate. The back plate has the support member and rim attached to it at a right angle. The locking mechanism attached to the back plate, allows for the attaching and releasing of the back plate from the anchoring plate. Conveniently, the basketball rim assembly will have a mounting means for removably attaching the back plate to the anchoring plate.

In accordance with yet another aspect of the invention, the locking mechanism consists of a cam assembly comprising of a displacement pin positioned within an opening of a hollow cylinder, a cam surface, a handle, a spring and a stopping means. The displacement pin is positioned into an opening in both the back plate and the anchoring plate. The displacement pin secures the back plate to the anchoring plate. A T-shaped end of a pole can be used to move the cam assembly so that the locking mechanism is unlocked. The back plate can be removed from the anchoring plate by screwing the opposite end of the pole, which may have a thread, into a threaded collar located on the support member. The basketball rim assembly may be conveniently made out of metal, with the anchoring plate being zinc plated to resist weathering and other damage.

Advantages of the present invention are: quick and easy removal of the basketball rim for storage, thereby preventing damage to the rim during the unsupervised hours of the play areas; removal of the basketball rim without requiring a ladder; secure mounting of the basketball rim thereby preventing movement of the rim during play.

BRIEF DESCRIPTION OF DRAWINGS

A detailed description of the preferred embodiment is provided herein below with reference to the following drawings, in which.

Figure 1:
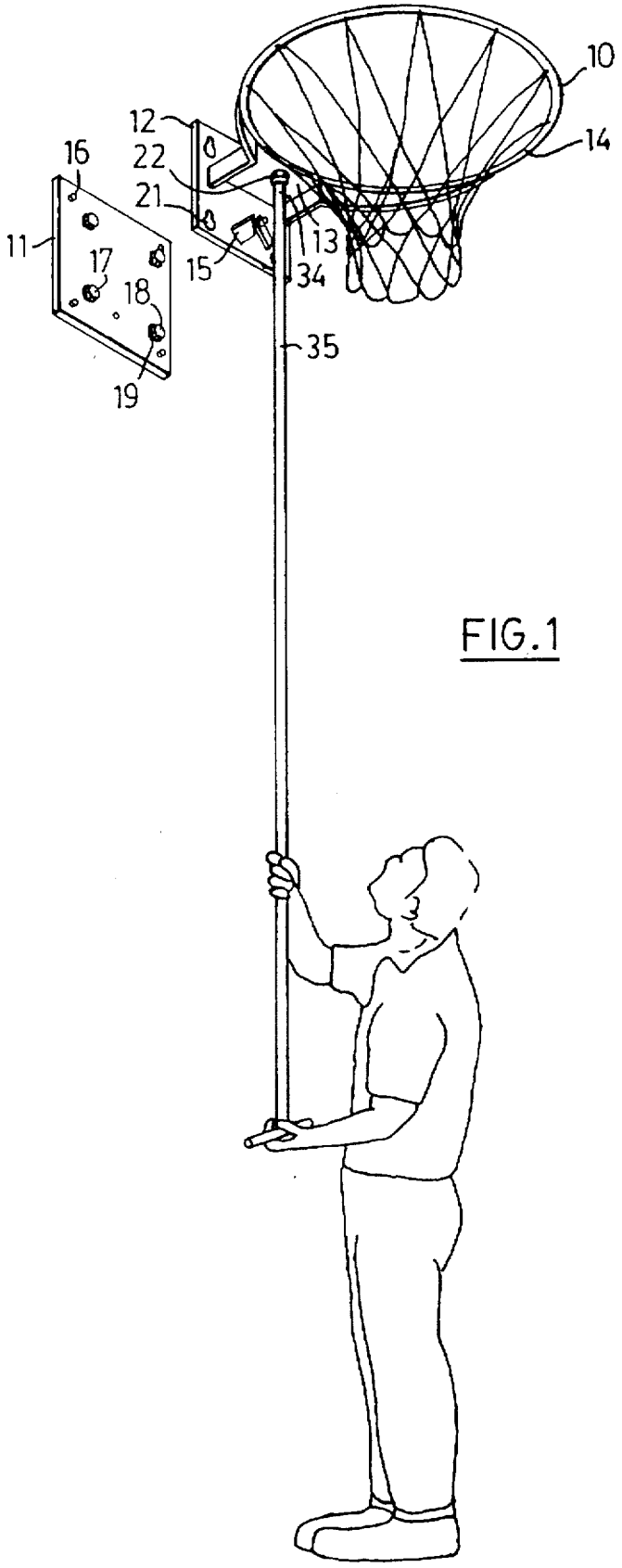
FIG. 1, in a perspective view, illustrates the basketball rim assembly in accordance with the preferred embodiment of the present invention.
Figure 3:
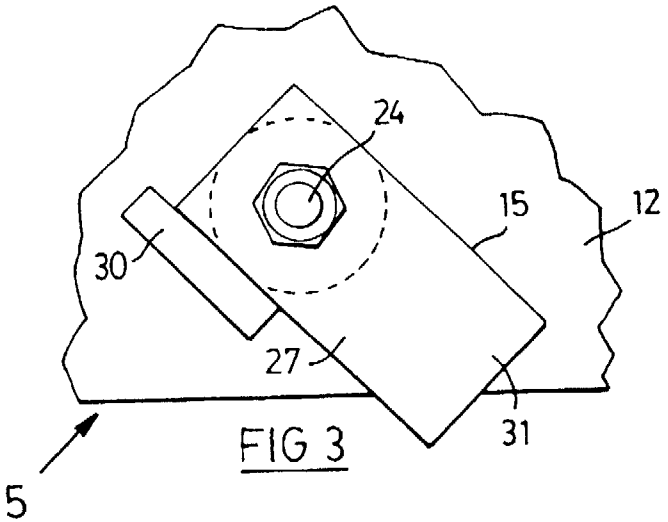
FIG. 3, in a top plan view, illustrates the locking mechanism in the locked position.
Figure 4:
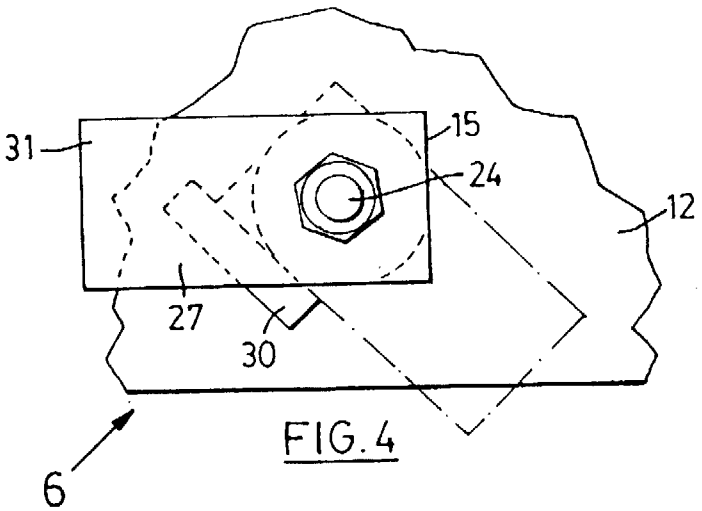
FIG. 4, in a top plan view, illustrates the locking mechanism in the unlocked position.

In the drawings, preferred embodiments of the invention are illustrated by way of example. It is to be expressly understood that the description and drawings are only for the purpose of illustration and as an aid to understanding, and are not intended as a definition of the limits of the invention.

BEST MODE FOR CARRYING OUT THE INVENTION

In the description which follows, like parts are marked throughout the specification and the drawings with the same respective reference numerals. The drawings are not necessarily to scale and in some instances proportions may have been exaggerated in order to more clearly depict certain features of the invention.

Referring to FIG. 1, there is illustrated in a perspective view, a basketball rim assembly 10 in accordance with the preferred embodiment of the present invention. The basketball rim assembly 10 for mounting on a surface includes an anchoring plate 11, a back plate 12, a support member 13, a rim 14 and a locking mechanism 15. The anchoring plate 11 includes a means for attaching to a surface 16 such as bolts or screws, and a mounting means 17 for removably attaching the anchoring plate 11 to the back plate 12. The mounting means 17 includes a bolt 18 and a milled collar 19. The mounting means 17 is assembled in such a way that the bolt 18 is slid through the milled collar 19 and threaded into holes in the anchoring plate 11. The bolt 18 and milled collar 19 are locked tight to the anchoring plate 11 with a commercial thread locking compound such as Loctite[1]*. The back plate 12 includes slots 21 to receive the mounting means 17.

* Indicates a trade name.

Figure 2:
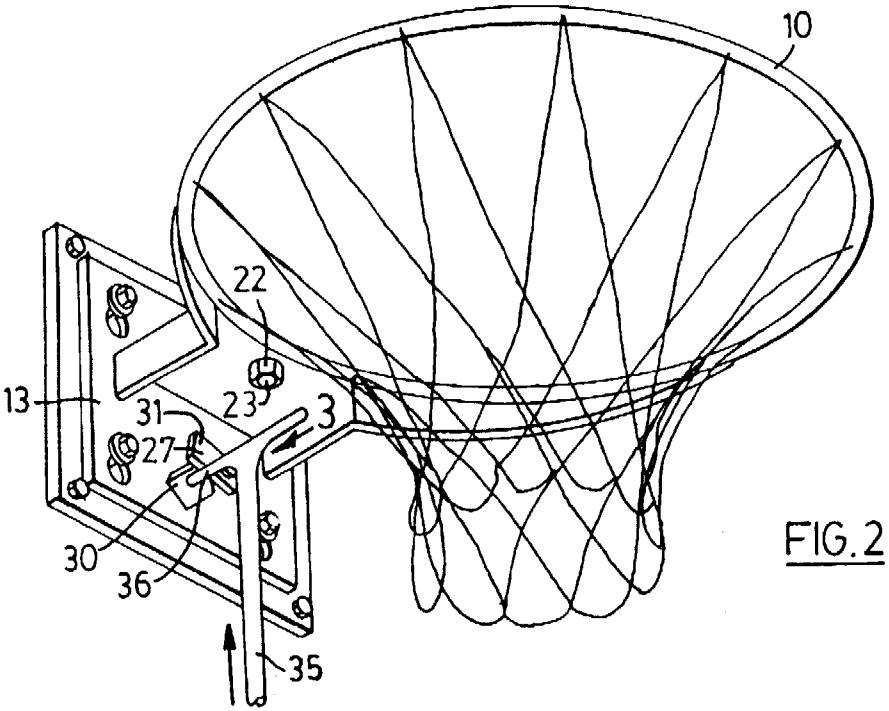
FIG. 2, in a perspective view, illustrates the basketball rim assembly of FIG. 1.
Figure 7:
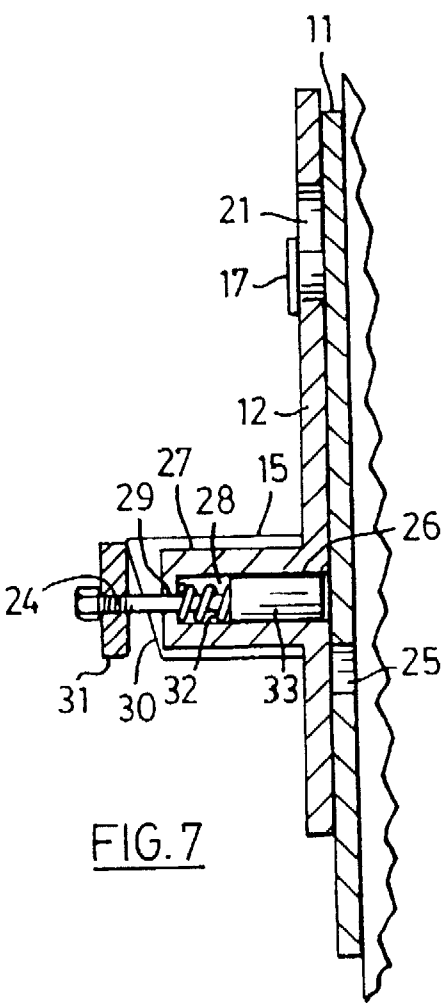
FIG. 7, in a cross-sectional view along the line 7—7, illustrates the basketball rim assembly of FIG. 2.
Figure 6:
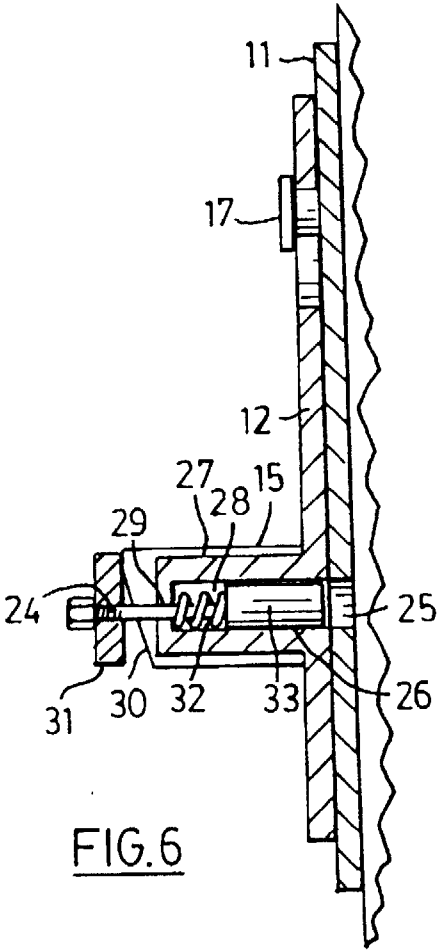
FIG. 6, in a cross-sectional view along the line 6—6, illustrates the locking mechanism of FIG. 4.
Figure 5:
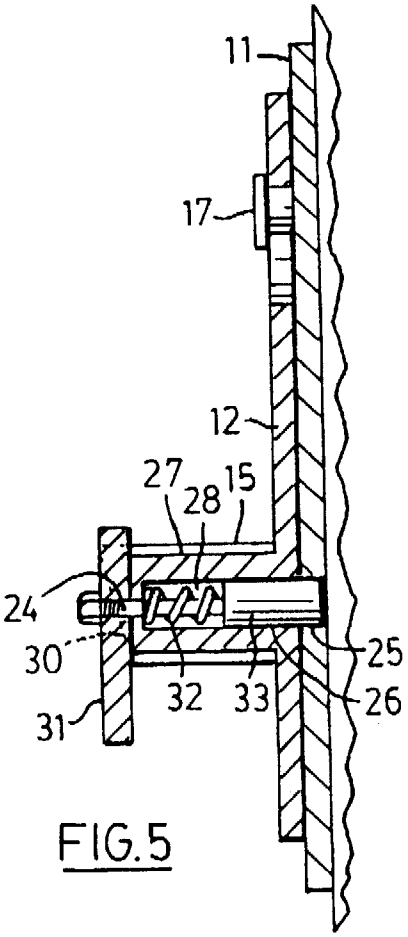
FIG. 5, in a cross-sectional view along the line 5—5, illustrates the locking mechanism of FIG. 3.

In FIG. 2, the basketball rim assembly 10 of FIG. 1 is illustrated in a perspective view. FIG. 2 shows the basketball rim assembly 10 described in FIG. 1, and further comprises of a collar 22 with a threaded opening 23 that depends in a vertical plane from the support member 13. The threaded opening 23 can receive the threaded end 34 of the pole 35.

Referring to FIGS. 3–7, there is illustrated in top plan views and cross-sectional views, a basketball rim assembly 10 in accordance with the preferred embodiment of the present invention. The basket ball rim assembly 10 includes a locking mechanism 15 comprising of a displacement pin 24, and an opening in both the anchoring plate 25 and the back plate 26 for receiving the displacement pin 24. The locking mechanism 15 further comprises a cam assembly 27 consisting of: a hollow cylinder 28 projecting outwardly and horizontally from the back plate 12 and having an opening 29; a cam surface 30; a handle 31; a spring 32; and a stopping means 33. The spring 32 surrounds the displacement pin 24, and is positioned between the stopping means 33 and the handle 31. The displacement pin 24, together with the spring 32 and stopping means 33, are positioned within the opening 29 of the hollow cylinder 28. The displacement pin 24 then fits through the openings of the back plate 26 and the anchoring plate 25.

In operation, the basketball rim assembly 10 can be quickly and easily removed to prevent damage to the rim 14, by unlocking the locking mechanism 15, and lifting the rim 14 off the mounting means 17. How this is achieved is explained herebelow with references to FIGS. 1–7. To mount the basketball rim assembly 10, the user moves the cam assembly 27 so that the handle 31 is positioned off the cam surface 30. The user screws the threaded end 34 of the pole 35 into the threaded opening 23 of the collar 22 that depends in a vertical plane from the support member 13. The user lifts the pole 35 attached to the support member 13 to the anchoring plate 11 already mounted on a flat surface, such as a wall, or a pole. The anchoring plate 11 has a mounting means 17 that receives the slots 21 located on the back plate 12, and securely attaches the back plate 12, support member 13 and rim 14 to the anchoring plate 11 by sliding the mounting means 17 into the slots 21. The threaded end 34 of the pole 35 is unscrewed from the threaded opening 23 of the collar 22.

When the mounting means 17 slides into the slots 21 of the anchoring plate 11, the displacement pin 24 is released from the spring action and moves through the openings in the back plate 26 and the anchoring plate 25. With the displacement pin 24 positioned in such a way, the locking mechanism 15 is in the locked position and the rim 14 is securely attached to the anchoring plate 11.

To remove the rim 14, the T-shaped end 36 of the pole 35 is used to push the handle 31 up the cam surface 30, thereby engaging the spring 32 and the stopping means 33 causing the displacement pin 24 to move out of the openings in both the back plate 26 and the anchoring plate 26, and releasing the locking mechanism 15. The pole 35 is then reversed and the threaded end 34 of the pole 35 is screwed into the vertically depending collar 22. The user slides the basketball rim assembly 10 with a vertical movement so that the slots 21 on the back plate 12 are free of the mounting means 17 on the anchoring plate 11. The user can then lift the basketball rim assembly 10 off the anchoring plate 11 and place the basketball rim assembly 10 on the ground to unscrew the pole 35.

Furthermore the anchoring plate 11 is adapted to be mounted to multiple surfaces such as a wall, a pole or the like. Moreover, the anchoring plate 11 may be mounted at different heights along the surface depending on the age group of the player.

In summary, a basketball rim assembly is provided with improved mounting features for quick, safe and easy mounting and removal of the basket ball rim assembly to prevent damage to the rim.

Various embodiments of the invention have now been described in detail. Since changes in and/or additions to the above-described best mode may be made without departing from the nature, spirit or scope of the invention, the invention is not to be limited to said details.

We claim:

1. A basketball rim assembly for mounting on a surface comprising:

(a) an anchoring plate;

(b) a back plate;

(c) a support member;

(d) a rim; and (e) a cam assembly;

wherein said anchoring plate, mounted on a surface, is removably attached to said back plate, said back plate associating with said support member and said rim at a right angle, said cam assembly having a hollow cylinder projecting horizontally outward from said back plate allowing for the locking and the removable attaching of said back plate to said anchoring plate.

2. A basketball rim assembly for mounting on a surface as claimed in claim 1 further comprising a means for attaching to said surface.

3. A basketball rim assembly for mounting on a surface as claimed in claim 2 further comprising a mounting means for removably attaching said anchoring plate to said back plate.

4. A basketball rim assembly for mounting on a surface as claimed in claim 3 wherein said mounting means comprises:

(a) a bolt; and (b) a collar.

5. A basketball rim assembly for mounting on a surface as claimed in claim 1 further comprising slots for attaching said back plate to said anchoring plate.

6. A basketball rim assembly for mounting on a surface as claimed in claim 5 further comprising a collar depending in a vertical plane from said support member, said collar defining an opening.

7. A basketball rim assembly for mounting on a surface as claimed in claim 6 wherein said opening is a threaded surface.

8. A basketball rim assembly for mounting on a surface as claimed in claim 1, said cam assembly further comprising a displacement pin and an opening in both said anchoring plate and said back plate for receiving said displacement pin.

9. A basketball rim assembly for mounting on a surface comprising:

(a) an anchoring plate;

(b) a back plate;

(c) a support member;

(d) a rim; and (e) a locking mechanism;

wherein said anchoring plate, mounted on a surface, is removably attached to said back plate, said back plate associating with said support member and said rim at a right angle, said locking mechanism affixed to said back plate and removably attaching said back plate to said anchoring plate;

(f) said locking mechanism further comprising a displacement pin and a opening in both said anchoring plate and said back plate for receiving said displacement pin;

(g) a cam assembly comprising:

(i) a hollow cylinder projecting horizontally outwardly from said back plate, said hollow cylinder defining an opening in said hollow cylinder, said displacement pin positioned within said opening;

(ii) a cam surface;

(iii) a handle;

(iv) a spring; and (v) a stopping means;

wherein said anchoring plate, mounted to a flat surface or pole, is removably attached to said back plate, said back plate associating with said support member and said rim at a right angle; said cam assembly having said handle attached to said displacement pin such that said handle contacts aid cam surface when said handle moves, from a first position, wherein said handle is not in contact with said cam surface to a second position wherein said handle comes in contact with said cam surface thereby engaging said spring and said stopping means causing said displacement pin to move within said opening of said hollow cylinder; said spring surrounding said displacement pin and positioned between said stopping means and said handle; said displacement pin, said stopping means, and said spring positioned in said hollow cylinder projecting horizontally outwardly from said back plate, said displacement pin positioned in said opening of both said back plate and said anchoring plate when said handle is in said first position.

10. A basketball rim assembly for mounting on multiple surfaces comprising:

(a) an anchoring plate having a means for attaching to multiple surfaces and a mounting means for removably attaching said basketball rim assembly to said anchoring plate;

(b) a back plate having slots for attaching said back plate to said anchoring plate;

(c) a support member having a collar depending in a vertical plane from said support member, said collar defining an opening;

(d) a rim attached to said support member;

(e) a locking mechanism having a displacement pin, and a opening in both said anchoring plate and said back plate for receiving said displacement pin; and (f) a pole having one T-shaped end and one threaded end;

wherein said anchoring plate, mounted to a surface, is removably attached to said back plate, said back plate associating with said support member and said rim at a right angle, said displacement pin positioned in said opening of both said back plate and said anchoring plate, and securing said back plate to said anchoring plate, said T-shaped end of said pole facilitating the movement of said cam assembly for moving said displacement pin out of said opening in both said anchoring plate and said back plate for removing said back plate, said support member and said rim; said threaded end of said pole being screwed into said opening of said collar on said support member such that said pole supports said basketball rim assembly when removing said basketball rim assembly from said surface.

11. A basketball rim assembly for mounting on multiple surfaces as claimed in claim 10, wherein said mounting means comprises:

(a) a bolt; and (b) a collar.

12. A basketball rim assembly for mounting on multiple surfaces as claimed in claim 11, wherein said cam assembly comprises:

(a) a hollow cylinder projecting horizontally outwardly from said back plate, said hollow cylinder defining an opening in said hollow cylinder, said displacement pin positioned within said opening;

(b) a cam surface;

(c) a handle;

(d) a spring; and (e) a stopping means;

wherein said anchoring plate, mounted to a flat surface or pole, is removably attached to said back plate, said back plate associating with said support member and said rim at a right angle; said cam assembly having said handle attached to said displacement pin such that said handle contacts said cam surface when said handle moves, from a first position, wherein said handle is not in contact with said cam surface to a second position wherein said handle comes in contact with said cam surface thereby engaging said spring and said stopping means causing said displacement pin to move within said opening of said hollow cylinder; said spring surrounding said displacement pin and positioned between said stopping means and said handle; said displacement pin, said stopping means, and said spring positioned in said hollow cylinder projecting horizontally outwardly from said back plate, said displacement pin positioned in said opening of both said back plate and said anchoring plate when said handle is in said first position.

* * * * *